US010683872B2

(12) United States Patent
Yamada

(10) Patent No.: US 10,683,872 B2
(45) Date of Patent: Jun. 16, 2020

(54) CENTRIFUGAL COMPRESSOR BUNDLE AND CENTRIFUGAL COMPRESSOR

(71) Applicant: MITSUBISHI HEAVY INDUSTRIES COMPRESSOR CORPORATION, Tokyo (JP)

(72) Inventor: Hideki Yamada, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 319 days.

(21) Appl. No.: 15/545,424

(22) PCT Filed: Jan. 27, 2015

(86) PCT No.: PCT/JP2015/052172
§ 371 (c)(1),
(2) Date: Jul. 21, 2017

(87) PCT Pub. No.: WO2016/120990
PCT Pub. Date: Aug. 4, 2016

(65) Prior Publication Data

US 2018/0010615 A1 Jan. 11, 2018

(51) Int. Cl.
*F04D 29/42* (2006.01)
*F04D 29/44* (2006.01)
*F04D 17/12* (2006.01)

(52) U.S. Cl.
CPC ..... *F04D 29/4213* (2013.01); *F04D 17/122* (2013.01); *F04D 17/125* (2013.01); *F04D 29/444* (2013.01)

(58) Field of Classification Search
CPC ..... F04D 17/122; F04D 17/125; F04D 29/44; F04D 29/441; F04D 29/444; F04D 29/4213
See application file for complete search history.

(56) References Cited

U.S. PATENT DOCUMENTS 3,051,090 A 8/1962 Zumbusch
3,733,145 A 5/1973 Kaplansky et al.
(Continued)

FOREIGN PATENT DOCUMENTS

CN 201606307 U 10/2010
DE 196 54 840 A1 6/1998
(Continued)

OTHER PUBLICATIONS

Written Opinion of the International Searching Authority and International Search Report (forms PCT/ISA/237 and PCT/ISA/210), dated Apr. 28, 2015, for International Application No. PCT/JP2015/052172, with English translations.

*Primary Examiner* — Igor Kershteyn
*Assistant Examiner* — Brian O Peters
(74) *Attorney, Agent, or Firm* — Birch, Stewart, Kolasch & Birch, LLP

(57) ABSTRACT

A centrifugal compressor bundle that is provided with a bundle main body in which is formed an annular intake flow channel (FC1) that is centered on an axis line (O) and that leads a process gas (G) into a flow channel (FC) of an impeller, and in which is also formed an annular discharge flow channel (FC2) that is centered on the axis line (O) and that discharges the process gas (G) from the flow channel (FC) of the impeller. The bundle main body has a plurality of diaphragms that are aligned in the direction of the axis line (O) and that are bonded to each other. From among the plurality of diaphragms, an intake diaphragm in which the intake flow channel (FC1) is formed is partitioned so as to have an upper-half part and a lower-half part that sandwich, from above and below, a horizontal plane that includes the axis line (O). The upper-half part and the lower-half part have the same rigidity in the direction of the axis line (O).

4 Claims, 5 Drawing Sheets

(56) References Cited

U.S. PATENT DOCUMENTS

| | | | | |
|---|---|---|---|---|
| 7,513,735 | B2 * | 4/2009 | Sarri | F04D 29/441 415/100 |
| 7,559,742 | B2 * | 7/2009 | Inoue | F04D 29/4213 415/184 |
| 9,163,643 | B2 * | 10/2015 | Masutani | F04D 29/441 |
| 2016/0017888 | A1 | 1/2016 | Nakaniwa et al. | |

FOREIGN PATENT DOCUMENTS

| | | | |
|---|---|---|---|
| JP | 62-59796 | U | 4/1987 |
| JP | 6-83988 | U | 12/1994 |
| JP | 10-318191 | A | 12/1998 |
| JP | 2014-185523 | A | 10/2014 |
| WO | WO 2005/045251 | A1 | 5/2005 |

* cited by examiner

CENTRIFUGAL COMPRESSOR BUNDLE AND CENTRIFUGAL COMPRESSOR

TECHNICAL FIELD

The present invention relates to a bundle in a centrifugal compressor and a centrifugal compressor having the bundle.

BACKGROUND ART

For example, in order to compress a process gas in various plants, a centrifugal compressor is used. In the centrifugal compressor, the process gas entering a bundle from a suction port is compressed in a flow channel of an impeller by rotating the impeller along with a rotary shaft, and the process gas is ejected to the outside of the bundle from the discharge port.

Meanwhile, a centrifugal compressor bundle is formed by connecting a plurality of disk-shaped members (diaphragms) such as an intake casing, a discharge casing, and an impeller housing disclosed in PTL 1 in a direction of a rotary shaft. Each diaphragm is divided into two portions on the horizontal plane in a vertical direction.

CITATION LIST

Patent Literature

[PTL 1] Japanese Unexamined Patent Application Publication No. 10-318191

SUMMARY OF INVENTION

Technical Problem

In a centrifugal compressor, since a fluid is compressed from an intake side toward a discharge side so as to increase a pressure of the fluid, a pressing force is applied in a direction of an axis line of a rotary shaft from a discharge diaphragm (discharge side diaphragm) toward an intake diaphragm (intake side diaphragm). Here, in the intake diaphragm, a shape of a side to which a suction port is connected is different from a shape of a side to which the suction port is not connected. That is, since shapes of an upper-half portion and a lower-half portion which are divided into two portions are different from each other, if the pressing force is applied to the portions, and there is a difference in deformation amounts of the upper-half portion and the lower-half portion in the direction of the axis line. As a result, if the pressing force is applied to the intake diaphragm, the diaphragm is deformed to be bent with respect to the axis line, and an operation of the compressor is likely to be failed.

The present invention provides a centrifugal compressor bundle capable of decreasing a bending deformation and a centrifugal compressor having this bundle.

Solution to Problem

According to a first aspect of the present invention, there is provided a centrifugal compressor bundle, including: a bundle main body which includes a rotary shaft, an intake flow channel which rotatably supports an impeller which is fixed to the rotary shaft and rotates along with the rotary shaft about an axis line of the rotary shaft, introduces a fluid in a flow channel of the impeller, and is annularly formed about the axis line, and a discharge flow channel which discharges the fluid from a flow channel of the impeller and is annularly formed about the axis line, in which the bundle main body includes a plurality of diaphragms which are aligned in the direction of the axis line and are connected to each other, and among the plurality of diaphragms, an intake diaphragm in which the intake flow channel is formed includes an upper-half portion positioned on an upper side and a lower-half portion positioned on a lower side configured by dividing the intake diaphragm into two portions such as the upper side and the lower side in a state where a horizontal plane including the axis line is interposed therebetween, and the upper-half portion and the lower-half portion have the same rigidity as each other in the direction of the axis line.

According to the centrifugal compressor bundle, a pressing force is applied to the intake diaphragm of the bundle main body in the direction of the axis line from a rear stage side toward a front stage side by the compressed fluid. In this case, since the rigidities of the upper-half portion and the lower-half portion of the intake diaphragm are the same as each other in the direction of the axis line, the upper-half portion and the lower-half portion are deformed by the same amount as each other in the direction of the axis line. Accordingly, the intake diaphragm is not deformed to be inclined with respect to the horizontal plane including the axis line, and the intake diaphragm is deformed in only the direction of the axis line.

In addition, in the centrifugal compressor bundle according to a second aspect of the present invention, in the first aspect, areas of contact surfaces between the intake diaphragm and the diaphragms which are adjacent to the intake diaphragm on the discharge flow channel side in the direction of the axis line may be the same as each other in the upper-half portion and the lower-half portion.

In this way, since the area of the contact surface with the adjacent diaphragm is the same in the upper-half portion and the lower-half portion, when the pressing force is applied to the intake diaphragm in the direction of the axis line by the compressed fluid, surface pressures on the contact surfaces of the upper-half portion and the lower-half portion can be the same as each other. Accordingly, since the intake diaphragm is deformed to be equally compressed in the direction of the axis line by the pressing force, the intake diaphragm is not deformed to be inclined with respect to the horizontal plane including the axis line, and the intake diaphragm is deformed in only the direction of the axis line.

In addition, in the centrifugal compressor bundle according to a third aspect of the present invention, in the first or second aspect, an inlet of the intake flow channel may be formed in the upper-half portion, the upper-half portion may include a first straightening plate which is provided in the inlet and extends in the radial direction, and a pair of second straightening plates which is disposed on both sides in a peripheral direction of the rotary shaft with respect to the first straightening plate and is provided to be separated from the first straightening plate toward the inside in the radial direction, and surfaces of the first straightening plate and the second straightening plate facing the direction of the axis line may configure a portion of the contact surface.

In this way, since the first straightening plate and the second straightening plate configure the contact surface with a head adjacent to the intake diaphragm in the direction of the axis line, it is possible to equalize deformation amounts of the upper-half portion and the lower-half portion without disturbing the flow of the fluid entering from the suction port to the intake flow channel.

In addition, in the centrifugal compressor bundle according to a fourth aspect of the present invention, in the third aspect, the contact surfaces of the intake diaphragm may be formed at positions separated by 90° around the axis line based on the position of the first straightening plate.

In this way, since the contact surfaces are formed at the positions every 90° in the peripheral direction, it is possible to approximately equally distribute the pressing force from the compressed fluid in the peripheral direction, and deformation of the upper-half portion and the lower-half portion can be generated in the direction of the axis line. Accordingly, it is possible to prevent the deformation of the intake diaphragm which is inclined with respect to the horizontal plane including the axis line, that is, it is possible to prevent generation of bending deformation.

In addition, according to a five aspect of the present invention, there is provided a centrifugal compressor, including: the centrifugal compressor bundle according to any one of the first to fourth aspects; a rotary shaft which is supported by the bundle so as to be rotatable with respect to the bundle; and an impeller which is fixed to the rotary shaft and rotates in the bundle main body along with the rotary shaft.

According to the centrifugal compressor, since the centrifugal compressor includes the bundle, when the pressing force is applied to the intake diaphragm of the bundle main body in the direction of the axis line from the rear stage side toward the front stage side by the compressed fluid, the upper-half portion and the lower-half portion are deformed by the same amount as each other in the direction of the axis line. Accordingly, the intake diaphragm is not deformed to be inclined with respect to the horizontal plane including the axis line, and the intake diaphragm is deformed in only the direction of the axis line.

Advantageous Effects of Invention

According to the centrifugal compressor bundle and the centrifugal compressor, since the rigidities of the upper-half portion and the lower-half portion of the intake diaphragm are the same as each other in the direction of the axis line, it is possible to prevent the bending deformation of the bundle main body.

DESCRIPTION OF EMBODIMENTS

Hereinafter, a centrifugal compressor 1 of an embodiment of the present invention will be described.

Figure 1:
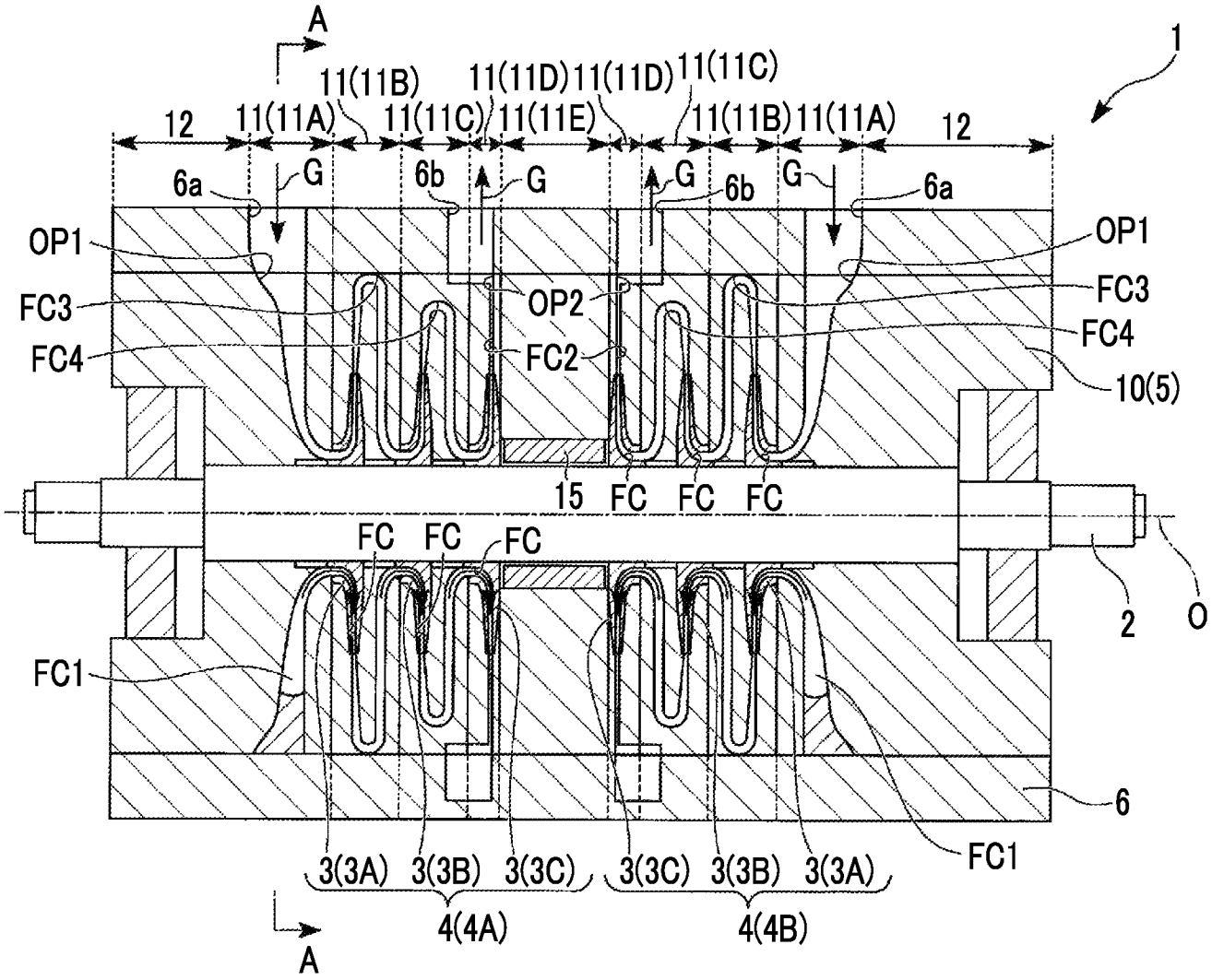
FIG. 1 is a longitudinal sectional view showing a schematic configuration of a centrifugal compressor in an embodiment of the present invention.

As shown in FIG. 1, in the present embodiment, as an example of the centrifugal compressor 1, a multi-stage centrifugal compressor will be described, in which a pair of three-stage impeller groups 4 which rotates about an axis line O is symmetrically disposed on one side and the other side in the direction of the axis line O.

The centrifugal compressor 1 includes a rotary shaft which rotates about the axis line O, a plurality of impellers 3 which are fixed to the rotary shaft 2, a bundle 5 which rotatably supports the rotary shaft 2 and the impellers 3, and an outside casing 6 which covers the bundle 5 from the outer peripheral side.

The rotary shaft 2 is formed in a columnar shape about the axis line O.

The plurality of impellers 3 (six impellers in the present embodiment) are arranged to be separated from each other in the direction of the axis line O.

Each of the impellers 3 has an approximately disk shape, is fitted to the rotary shaft 2, and is rotatable about the axis line O along with the rotary shaft 2. In addition, a flow channel FC through which a process gas G (fluid) can flow is formed in each impeller 3.

In three impellers 3 which are disposed on one side (a left side toward a paper surface of FIG. 1) in the direction of the axis line O, an inlet of the flow channel FC of each impeller 3 is disposed toward the one side in the direction of the axis line O, and the three impellers 3 configure one impeller group 4 (hereinafter, referred to as a first impeller group 4A).

In three-stage impellers 3 which are disposed on the other side (the right side toward the paper surface of FIG. 1) in the direction of the axis line O, an inlet of the flow channel FC of the impeller 3 is disposed toward the other side in the direction of the axis line O, and the three-stage impellers 3 configure one impeller group 4 (hereinafter, referred to as a second impeller group 4B).

The bundle 5 includes a plurality of diaphragms 11 which are formed in disk shapes about the axis line O and a bundle main body 10 having heads 12.

The plurality of diaphragms 11 and the heads 12 are connected in the direction of the axis line O by bolts (not shown) to form the bundle main body 10. That is, the bundle main body 10 has a structure which is divided into a plurality of portions on a cross-section orthogonal to the axis line O.

A pair of heads 12 is provided such that the plurality of diaphragms 11 are interposed between both ends of the axis line O in the direction of the axis line O, and each head is a member which is formed in a disk shape about the axis line O.

Each diaphragm 11 has a structure which is divided into two portions in a vertical direction on a horizontal plane including the axis line O.

In the bundle main body 10, the diaphragms 11 of one end portion and the other end portion in the direction of the axis line O become intake diaphragms 11A. In each intake diaphragm 11A, an intake flow channel FC1 which is annually formed about the axis line O and through which the process gas G can be introduced to the flow channel FC of the impeller 3 is formed. In the intake flow channel FC1, an intake flow channel opening OP1 (inlet) is formed, which is open to the outside in the radial direction on a portion (the upper portion in the present embodiment) in the peripheral direction in the intake diaphragm 11A.

The intake diaphragm 11A is divided in the vertical direction, and includes an upper-half portion 20 which is formed in a semi-disk shape and is positioned on the upper side, and a lower-half portion 30 which is formed in a semi-disk shape and is positioned on the lower side. The details of the upper-half portion 20 and the lower-half portion 30 will be described later.

In the bundle main body 10, the diaphragm 11 which covers the initial stage (first stage) impeller 3(3A) in each of the first impeller group 4A and the second impeller group 4B becomes a first intermediate diaphragm 11B. In the first intermediate diaphragm 11B, a return flow channel FC3 which communicates with an outlet of the flow channel FC of the initial stage impeller 3 (3A) and an inlet of a flow channel FC of an intermediate stage (second stage) impeller 3 (3B) is formed.

Similarly, in the bundle main body 10, the diaphragm which covers the intermediate stage (second stage) impeller 3(3B) in each of the first impeller group 4A and the second impeller group 4B becomes a second intermediate diaphragm 11C. In the second intermediate diaphragm 11C, a return flow channel FC4 which communicates with an outlet of the flow channel FC of the intermediate stage impeller 3 (3B) and an inlet of the flow channel FC of a final stage (third stage) impeller 3 (3C) is formed.

In the second intermediate diaphragm 11C, a portion of a discharge flow channel FC2 which is annularly formed about the axis line O and can discharge the process gas G from the flow channel FC of the impeller 3 is formed.

In the bundle main body 10, the diaphragm 11 which covers the final stage (third stage) impeller 3 (3C) in each of the first impeller group 4A and the second impeller group 4B becomes a discharge diaphragm 11D. In the discharge diaphragm 11D, a portion of the remainder of the discharge flow channel FC2 which is annularly formed about the axis line O and can discharge the process gas G from the flow channel FC of the impeller 3 is formed.

That is, the discharge flow channel FC2 is formed by the discharge diaphragm 11D and the second intermediate diaphragm 11C. In the discharge flow channel FC2, a discharge flow channel opening OP2 (outlet) is formed, which is open to the outside in the radial direction at a portion (the upper portion in the present embodiment) of the second intermediate diaphragm 11C and the discharge diaphragm 11D in the peripheral direction.

In the bundle main body 10, the diaphragm 11 which is disposed at a position interposed between the first impeller group 4A and the second impeller group 4B becomes a diaphragm 11E between final stages. In the diaphragm 11E between final stages, a seal device 15 which seals the flow of the process gas G between the first impeller group 4A and the second impeller group 4B is provided on the outer peripheral side of the rotary shaft 2.

The outside casing 6 is formed in a cylindrical shape, covers the bundle main body 10 from the outer peripheral side, and fixes the bundle main body 10. A pair of suction ports 6*a* which extends in the radial direction, is open to the outside, and communicates with the intake flow channel opening OP1 is formed in the outside casing 6. In addition, a pair of discharge ports 6*b* which extends in the radial direction, is open to the outside, and communicates with the discharge flow channel opening OP2 is formed in the outside casing 6.

In the present embodiment, the suction ports 6*a* and the discharge ports 6*b* are formed on the upper portion of the outside casing 6 so as to extend upward.

Figure 2:
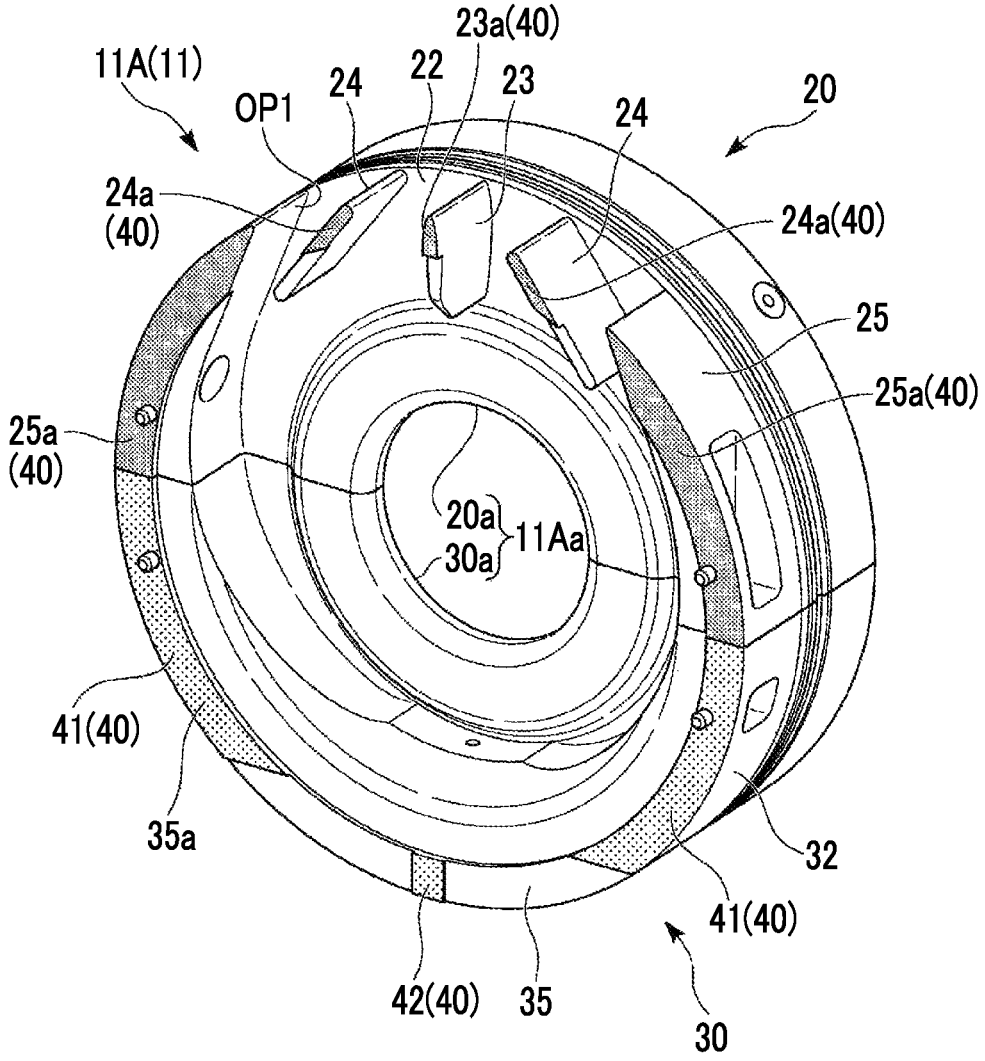
FIG. 2 is a perspective view showing an intake diaphragm which forms an intake flow channel of the centrifugal compressor in the embodiment of the present invention.

Next, the details of the upper-half portion 20 and the lower-half portion 30 of the intake diaphragm 11A will be described with reference to FIGS. 2 and 3.

The upper-half portion 20 includes a main body portion 22 which is formed in a semi-disk shape about the axis line O and a first straightening plate 23, second straightening plates 24, and outer wall portions 25 which protrude from the main body portion 22 toward the head 12 side in the direction of the axis line O.

A semicircular opening 20*a* which surrounds the rotary shaft 2 from the outer peripheral side is formed at the position inside the main body portion 22 in the radial direction.

The first straightening plate 23 extends in the radial direction (in the vertical direction) from the intake flow channel opening OP1 toward the inside in the radial direction, protrudes from the main body portion 22 toward the head 12 side in the direction of the axis line O, and is formed in a vane shape when viewed in the direction of the axis line O.

That is, after the thickness dimension of the first straightening plate 23 in the peripheral direction gradually increases toward the inside in the radial direction, the thickness dimension gradually decreases.

In the first straightening plate 23, an approximately half portion 23*a* on the outside in the radial direction of a surface facing the head 12 side in the direction of the axis line O becomes a portion of a contact surface 40 with the head 12 adjacent to the intake diaphragm 11A in the direction of the axis line O.

The second straightening plates 24 are disposed to be separated from the first straightening plate 23, and are disposed to be inclined so as to be separated from the first straightening plate 23 toward the inside in the radial direction at each of both sides in the peripheral direction with respect to the first straightening plate 23.

That is, the process gas G from the suction port 6*a* can flow through a portion between the second straightening plate 24 and the first straightening plate 23.

Each second straightening plate 24 protrudes from the main body portion 22 toward the head 12 side in the direction of the axis line O, and is formed in a rectangular shape when viewed in the direction of the axis line O.

In the second straightening plate 24, an approximately half portion 24*a* on the outside in the radial direction of a surface facing the head 12 side in the direction of the axis line O becomes a portion of a contact surface 40 with the head 12 adjacent to the intake diaphragm 11A.

A pair of outer wall portions 25 is provided to be curved along the outer peripheral surface of the main body portion 22 and forms the outer wall of the intake flow channel FC1. In addition, the pair of outer wall portions is formed to the position separated from the second straightening plate 24 in the peripheral direction on the upper portion. That is, the process gas G can flow through a portion between the second straightening plates 24.

Since the thickness dimension of the outer wall portion 25 in the radial direction gradually increases downward, a flow channel area of the intake flow channel FC1 gradually decreases downward.

In the surface of the outer wall portion 25 facing the discharge flow channel FC2 side in the direction of the axis line O, only a portion 25*a* along the peripheral surface of the main body portion 22 becomes a portion of the contact surface 40 with the head 12. The width dimension of the portion 25*a* along the peripheral surface in the radial direction is constant in the peripheral direction.

The lower-half portion 30 includes a main body portion 32 which is formed in a semi-disk shape about the axis line O and an outer wall portion 35 which protrudes from the main body portion 32 toward the head 12 side in the direction of the axis line O.

In the main body portion 32, a semicircular opening 30*a* which surrounds the rotary shaft 2 from the outer peripheral side at the position on the inside in the radial direction is formed. A circular opening 11Aa into which the rotary shaft 2 can be inserted is formed by the opening 30*a* and the opening 20*a* in the main body portion 22 of the upper-half portion 20.

The outer wall portion 35 is curved along the outer peripheral surface of the main body portion 32, is provided on the entire region of the outer peripheral surface of the main body portion 32, and forms the outer wall of the intake flow channel FC1.

Since the thickness dimension in the radial direction of the outer wall portion 35 gradually increases downward, the flow channel area of the intake flow channel FC1 gradually decreases downward.

The thickness of the upper end portion of the outer wall portion 35 coincides with the thickness of the lower end portion of the outer wall portion 25 of the upper-half portion 20, and the outer wall portion 35 of the lower-half portion 30 and the outer wall portion 25 of the upper-half portion 20 are smoothly connected to each other without steps.

In addition, in the surface of the outer wall portion 35 facing the head 12 side in the direction of the axis line O, only a portion of an annular portion 35*a* of a half circumference about the axis line O along the outer peripheral surface of the main body portion 32 becomes a portion of the contact surface 40 with the head 12.

More specifically, as the contact surface 40 in the lower-half portion 30, a pair of curved surfaces 41 which is formed from the upper end portion of the lower-half portion 30 to the intermediate position in the vertical direction, and an approximately rectangular lower end surface 42 which is formed on the lower end portion to be separated from the curved surfaces 41 in the peripheral direction are formed on the lower-half portion 30.

In the curved surfaces 41 and the lower end surface 42, the outer wall portion 35 is formed to be recessed in the direction of the axis line O between the curved surface 41 and the lower end surface 42.

The width dimensions of the curved surfaces 41 and the lower end surface 42 in the radial direction are the same as the width dimensions in the radial direction of the portions 25*a* along the outer peripheral surface in the outer wall portion 25 of the upper-half portion 20, and the width dimensions are constant in the peripheral direction.

Moreover, in the present embodiment, the upper-half portion 20 and the lower-half portion 30 are formed of the same material, and rigidities of the upper-half portion 20 and the lower-half portion 30 are the same as each other.

In addition, the area of the contact surface 40 of the upper-half portion 20 is the same as the area of the contact surface 40 of the lower-half portion 30. Moreover, in the present embodiment, the contact surfaces 40 are formed at least positions separated by 90° around the axis line O based on the position of the first straightening plate 23.

According to the above-described centrifugal compressor 1, a force is generated in the direction of the axis line O from the front stage side (discharge diaphragm 11D side) toward the rear stage side (intake diaphragm 11A side) by the compressed process gas G, and this force becomes a pressing force and is applied to the intake diaphragm 11A.

In this case, since the rigidities of the upper-half portion 20 and the lower-half portion 30 of the intake diaphragm 11A are the same as each other in the direction of the axis line O, the upper-half portion 20 and the lower-half portion 30 are deformed by the same amount as each other in the direction of the axis line O. Accordingly, the intake diaphragm 11A is not deformed to be inclined with respect to the horizontal plane including the axis line O, and the intake diaphragm 11A is deformed in only the direction of the axis line O. Accordingly, it is possible to prevent the intake diaphragm 11A from being inclined to the horizontal plane and bending-deformed.

In addition, since the area of the contact surface of the upper-half portion 20 and the area of the contact surface 40 of the lower-half portion 30 are the same as each other, when the pressing force is applied to the intake diaphragm 11A in the direction of the axis line O by the compressed process gas G, surface pressures on the contact surfaces 40 of the upper-half portion 20 and the lower-half portion 30 can be the same as each other.

Accordingly, since the intake diaphragm 11A is deformed to be equally compressed in the direction of the axis line O by the pressing force, it is possible to further prevent the bending deformation of the intake diaphragm 11A.

In addition, since the first straightening plate 23 and the second straightening plates 24 configure the contact surface 40 with the head 12, it is possible to equalize deformation amounts of the upper-half portion 20 and the lower-half portion 30 without disturbing the flow of the process gas G entering from the suction port 6*a* to the intake flow channel FC1.

Particularly, in the present embodiment, since the first straightening plate 23 is formed in a vane shape, it is possible to introduce the process gas G into the intake flow channel FC1 without separating the process gas G from the suction port 6*a*.

Moreover, in the intake diaphragm 11A, since the contact surfaces 40 are formed at the positions at least every 90° in the peripheral direction, it is possible to approximately equally distribute the pressing force in the peripheral direction, and deformation of the upper-half portion 20 and the lower-half portion 30 due to the pressing force can be generated in the direction of the axis line O. Accordingly, it is possible to prevent generation of the bending deformation in the intake diaphragm 11A.

[Example]

Here, with reference to FIGS. 4 to 7, a test confirming deformation amounts of the bundle 5 due to the pressing force was performed on examples in which shapes of the upper-half portion and the lower-half portion were different from each other.

Figure 4:
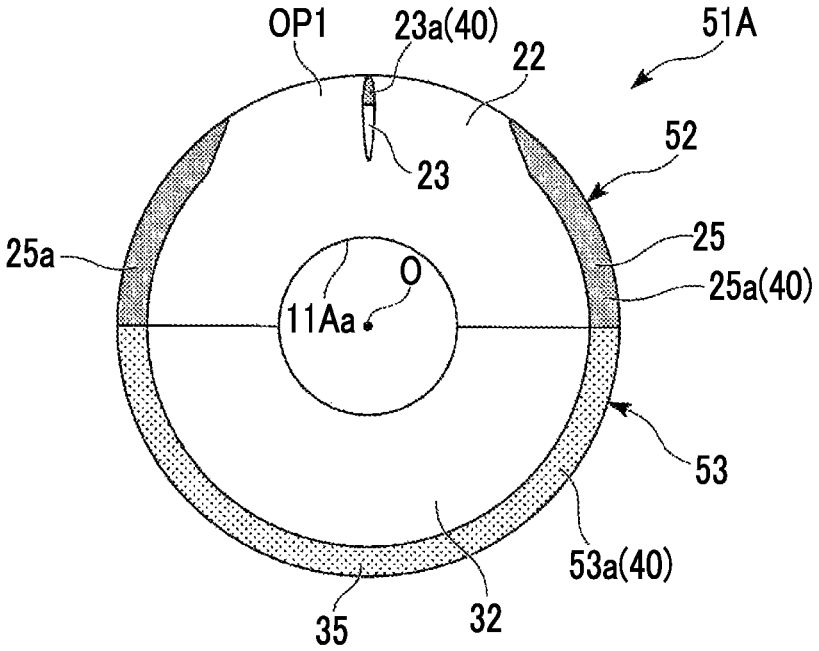
FIG. 4 is a view showing an intake diaphragm of a first example of examples of the centrifugal compressor, and a sectional view at a position corresponding to the A-A cross section of FIG. 1.

In an intake diaphragm 51A shown in FIG. 4, an upper-half portion 52 includes the main body portion 22, the first straightening plate 23, and the outer wall portion 25, and the lower-half portion 53 includes the main body portion 32 and the outer wall portion 35.

In the upper-half portion 52, the contact surface 40 with the head 12 is configured of approximately the half portion 23*a* (the portion similar to that of the above-described embodiment) on the outside in the radial direction in the surface of the first straightening plate facing the head 12 side in the direction of the axis line O, and the portion 25*a* along the outer peripheral surface of the main body portion 22 in the surface of the outer wall portion 25 facing the head 12 side in the direction of the axis line O.

In addition, in the lower-half portion 53, the contact surface 40 is configured of the entire region of an annular portion 53*a* of a half circumference about the axis line O along the outer peripheral surface of the main body portion 32 in the surface of the outer wall portion facing the head 12 side in the direction of the axis line O. The width dimension in the radial direction of the annular portion 53*a* of the half circumference is constant in the peripheral direction.

In the intake diaphragm 51A, since the deformation amount of the upper-half portion 52 in the direction of the axis line O was large and the deformation amount of the lower-half portion 53 in the direction of the axis line O was small, the bundle main body 10 was bending-deformed such that the upper-half portion 52 was inclined to the head 12 side with respect to the axis line O.

Figure 5:
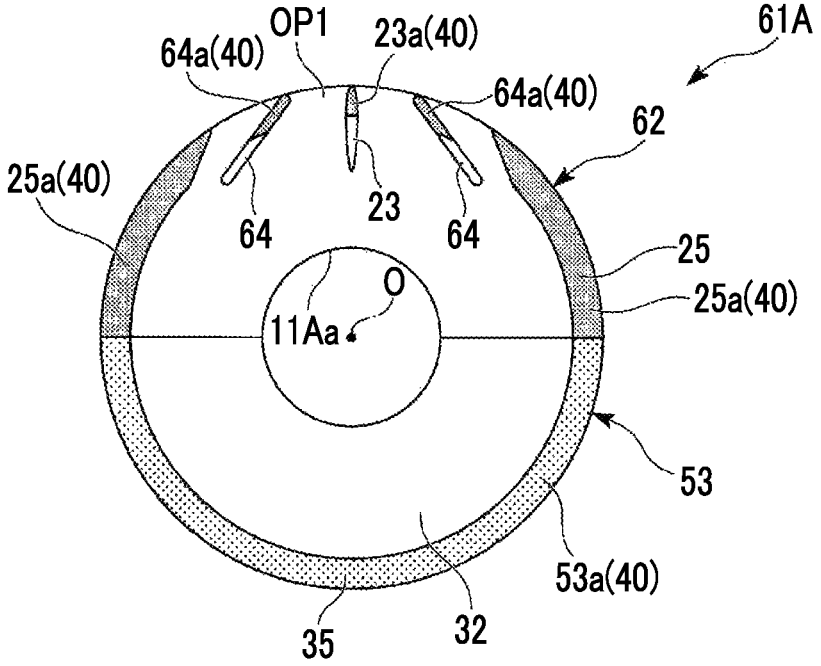
FIG. 5 is a view showing an intake diaphragm of a second example of examples of the centrifugal compressor, and a sectional view at the position corresponding to the A-A cross section of FIG. 1.

Accordingly, as shown in FIG. 5, second straightening plates 64 were further provided on both sides in the peripheral direction with respect to the first straightening plate 23 in the upper-half portion 62 of the intake diaphragm 61A. The thickness dimension of each of the second straightening plate 64 in the peripheral direction is 6 [mm]. In the second straightening plate 64, an approximately half portion 64*a* on the outside in the radial direction in the surface facing the head 12 side in the direction of the axis line O becomes a portion of the contact surface 40.

As result, the deformation amount of the upper-half portion 62 was small in the direction of the axis line O, but a difference between the deformation amount of the lower-half portion 53 in the direction of the axis line O was large, and the bundle main body 10 was still bending-deformed such that the upper-half portion 62 was inclined to the head 12 side with respect to the axis line O.

Figure 6:
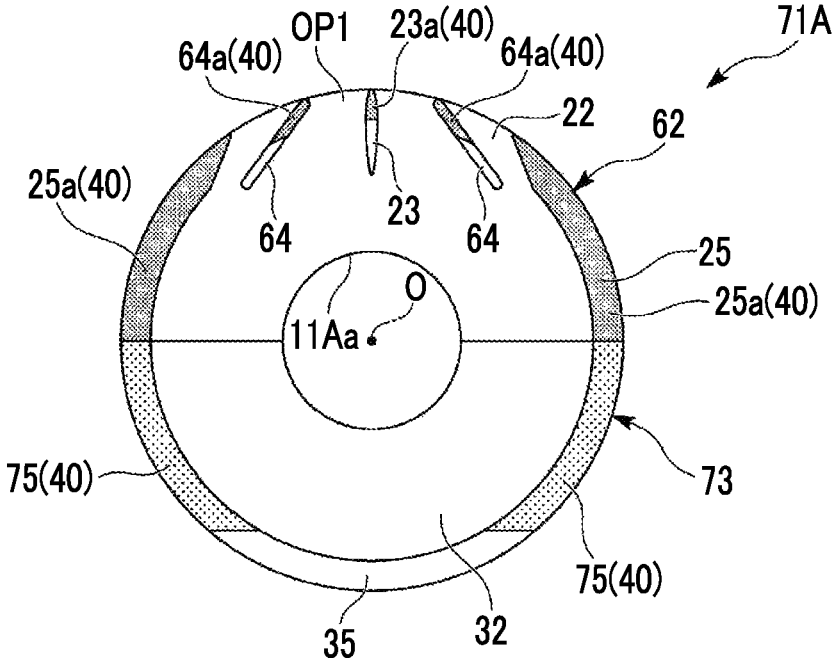
FIG. 6 is a view showing an intake diaphragm of a third example of examples of the centrifugal compressor, and a sectional view at the position corresponding to the A-A cross section of FIG. 1.

In addition, as shown in FIG. 6, in an intake diaphragm 71A, in the portion 53*a* (refer to FIG. 5) forming an annular shape of a half circumference in the outer wall portion 35 of the lower-half portion 73, the outer wall portion 35 was recessed in the direction of the axis line O in a predetermined region of the lower portion so as to decrease the area of the contact surface 40, and a pair of curved surfaces 75 was formed in the contact surface 40.

As a result, the deformation amount of the lower-half portion 73 in the direction of the axis line O was large, and the bundle main body 10 was bending-deformed such that the lower-half portion 73 was inclined to the head 12 side.

Figure 7:
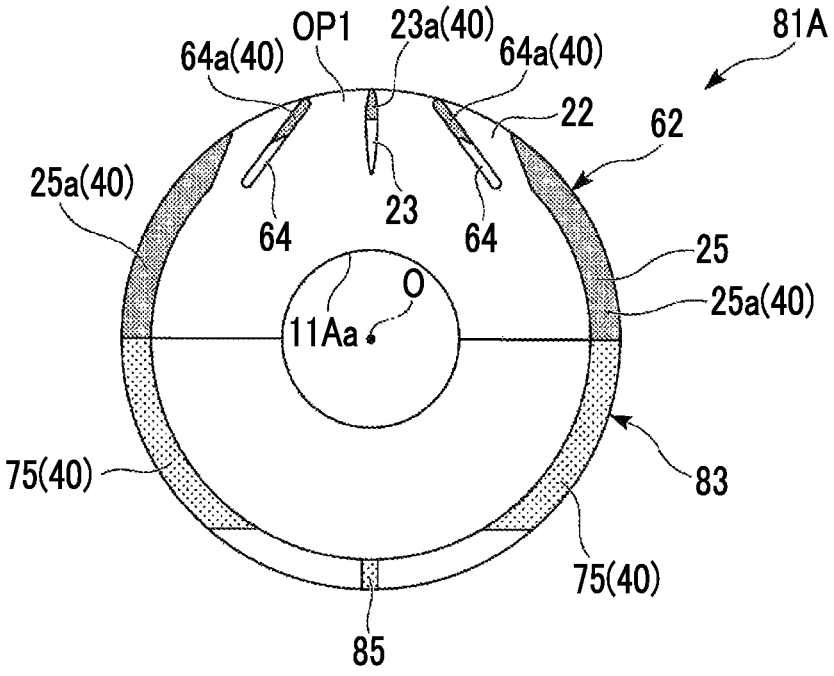
FIG. 7 is a view showing an intake diaphragm of a fourth example of examples of the centrifugal compressor, and a sectional view at the position corresponding to the A-A cross section of FIG. 1.

Accordingly, in the intake diaphragm 81A shown in FIG. 7, in the outer wall portion 35, an approximately rectangular lower end surface 85 was formed on the lower end portion of the lower-half portion 83 as the contact surface 40 at the position interposed between the pair of curved surfaces 75 in the peripheral direction. Accordingly, the deformation amount of the lower-half portion 83 in the direction of the axis line O and the deformation amount of the upper-half portion 62 in the direction of the axis line O were equalized, and the bending deformation of the bundle main body 10 inclined to the head 12 side was prevented. However, a contact surface pressure of the approximately half portion 64*a* of on the outside of the second straightening plate 24 in the radial direction exceeded allowable stress.

Figure 3:
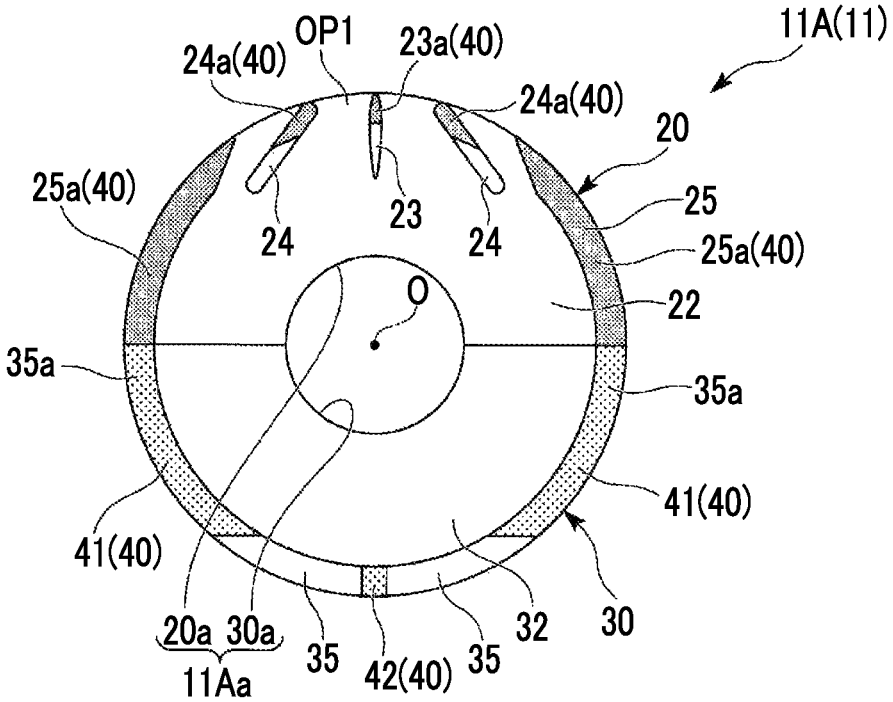
FIG. 3 is a view showing the intake diaphragm which forms the intake flow channel of the centrifugal compressor in the embodiment of the present invention and is a sectional view showing an A-A cross section of FIG. 1.

Accordingly, finally, in the intake diaphragm 11A of the above-described embodiment shown in FIG. 3, the thickness of the second straightening plate 24 in the peripheral direction in the upper-half portion 20 was set to 12 mm, and the width dimension of the lower end surface of the lower-half portion 30 in the peripheral direction was increased to increase the area of the contact surface 40.

As a result, the contact surface pressure of the approximately half portion 64*a* of on the outside of the second straightening plate 24 in the radial direction was equal or less than the allowable stress, the deformation amounts of the upper-half portion 20 and the lower-half portion 30 in the direction of the axis line O could be the same as each other, and it was possible to prevent the bending deformation of the bundle main body 10.

Hereinbefore, the embodiment of the present invention is described with reference to the drawings, components in each embodiment, a combination thereof, and the like are examples, and addition, omission, replacement, and other modifications of configurations can be applied within a scope which does not depart from the gist of the present invention. In addition, the present invention is not limited by the embodiment and is limited by only claims.

For example, the first straightening plate 23 may not be formed in a vane shape when viewed in the direction of the axis line O, and may be formed in a rectangular shape similarly to the second straightening plate 24.

In addition, similarly to the first straightening plate 23, the second straightening plate 24 may be formed in a vane shape when viewed in the direction of the axis line O.

In addition, the number of the first straightening plates 23 and the number of the second straightening plates 24 are not limited.

INDUSTRIAL APPLICABILITY

In the above-described centrifugal compressor bundle and the centrifugal compressor, since the rigidities of the upper-half portion and the lower-half portion of the intake diaphragm in the direction of the axis line are the same as each other, it is possible to prevent the bending deformation of the bundle main body.

REFERENCE SIGNS LIST

1: centrifugal compressor
2: rotary shaft
3, 3A, 3B: impeller
4: impeller group
4A: first impeller group
4B: second impeller group
5: bundle
6: outside casing
6*a*: suction port
6*b*: discharge port
10: bundle main body
11: diaphragm
11A, 51A, 61A, 71A, 81A: intake diaphragm
11Aa: opening
11B: first intermediate diaphragm
11C: second intermediate diaphragm
11D: discharge diaphragm
11E: diaphragm between final stages
12: head
15: seal device
20, 52, 62: upper-half portion
20*a*: opening
22: main body portion
23: first straightening plate
24, 64: second straightening plate
25: outer wall portion
30, 53, 73, 83: lower-half portion
30*a*: opening
32: main body portion

35: outer wall portion
40: contact surface
41, 75: curved surface
42, 85: lower end surface
FC: flow channel
FC1: intake flow channel
OP1: intake flow channel opening
FC2: discharge flow channel
OP2: discharge flow channel opening
FC3: return flow channel
FC4: return flow channel
O: axis line
G: process gas (fluid)

The invention claimed is:

1. A centrifugal compressor bundle, comprising:

a bundle main body which includes a rotary shaft, an intake flow channel which rotatably supports an impeller which is fixed to the rotary shaft and rotates along with the rotary shaft about an axis line of the rotary shaft, introduces a fluid in a flow channel of the impeller, and is annularly formed about the axis line, and a discharge flow channel which discharges the fluid from a flow channel of the impeller and is annularly formed about the axis line, wherein the bundle main body includes a plurality of diaphragms which are aligned in the direction of the axis line and are connected to each other, wherein among the plurality of diaphragms, an intake diaphragm in which the intake flow channel is formed includes an upper-half portion positioned on an upper side and a lower-half portion positioned on a lower side configured by dividing the intake diaphragm into two portions such as the upper side and the lower side in a state where a horizontal plane including the axis line is interposed therebetween, wherein areas of contact surfaces between the intake diaphragm and one of the diaphragms which is adjacent to the intake diaphragm on the discharge flow channel side in the direction of the axis line are the same as each other in the upper-half portion and the lower-half portion, wherein an inlet of the intake flow channel is formed between the upper-half portion of the intake diaphragm and the adjacent diaphragm, wherein the upper-half portion includes a first straightening plate which is provided in the inlet and extends in the radial direction, and a pair of second straightening plates which is disposed on both sides in a peripheral direction of the rotary shaft with respect to the first straightening plate and is provided to be separated from the first straightening plate toward the inside in the radial direction, wherein the lower-half portion includes an outer wall portion provided on the entire region of an outer peripheral surface of the lower-half portion, wherein surfaces of the first straightening plate and the second straightening plate facing the direction of the axis line are contacted with the adjacent diaphragm as a portion of the contact surface of the upper-half portion, wherein a surface of the outer wall portion facing the direction of the axis line includes a first part which is contacted with the adjacent diaphragm as a portion of the contact surface of the lower-half portion, and a second part which is not contacted with the adjacent diaphragm, and wherein the upper-half portion and the lower-half portion have the same rigidity as each other in the direction of the axis line.

2. The centrifugal compressor bundle according to claim 1, wherein the contact surfaces of the intake diaphragm are formed at positions separated by 90° around the axis line based on the position of the first straightening plate.

3. A centrifugal compressor, comprising:

the centrifugal compressor bundle according claim 1;

the rotary shaft which is supported by the bundle so as to be rotatable with respect to the bundle; and the impeller which is fixed to the rotary shaft and rotates in the bundle main body along with the rotary shaft.

4. A centrifugal compressor, comprising:

the centrifugal compressor bundle according to claim 2;

the rotary shaft which is supported by the bundle so as to be rotatable with respect to the bundle; and the impeller which is fixed to the rotary shaft and rotates in the bundle main body along with the rotary shaft.

* * * * *